US008505870B2

(12) United States Patent
Yadav et al.

(10) Patent No.: US 8,505,870 B2
(45) Date of Patent: Aug. 13, 2013

(54) SHEAR BLADE GEOMETRY AND METHOD

(75) Inventors: Seemant Yadav, Houston, TX (US); Luis Melendez, Humble, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 170 days.

(21) Appl. No.: 13/019,438

(22) Filed: Feb. 2, 2011

(65) Prior Publication Data

US 2012/0193556 A1 Aug. 2, 2012

(51) Int. Cl.
*E21B 33/06* (2006.01)

(52) U.S. Cl.
USPC ..... 251/1.3; 166/85.4

(58) Field of Classification Search
USPC ..... 251/1.1, 1.2, 1.3; 166/85.4, 363, 166/364
See application file for complete search history.

(56) References Cited

U.S. PATENT DOCUMENTS

| | | | | | |
|---|---|---|---|---|---|
| 2,512,744 | A * | 6/1950 | Hill | 251/1.3 |
| 2,832,134 | A * | 4/1958 | Lukan | 30/443 |
| 2,919,111 | A * | 12/1959 | Nicolson | 166/352 |
| 3,554,278 | A * | 1/1971 | Reistle et al. | 166/85.1 |
| 3,716,068 | A * | 2/1973 | Addison | 137/67 |
| 4,553,730 | A * | 11/1985 | Vicic | 251/1.3 |
| 5,013,005 | A * | 5/1991 | Nance | 251/1.3 |
| 5,064,164 | A * | 11/1991 | Le | 251/1.1 |
| 5,237,899 | A * | 8/1993 | Schartinger | 83/454 |
| 7,367,396 | B2 | 5/2008 | Springett | |
| 7,814,979 | B2 * | 10/2010 | Springett et al. | 166/298 |
| 8,066,070 | B2 * | 11/2011 | Springett et al. | 166/298 |

* cited by examiner

*Primary Examiner* — John K Fristoe, Jr.
*Assistant Examiner* — Umashankar Venkatesan
(74) *Attorney, Agent, or Firm* — Bracewell & Giuliani LLP

(57) ABSTRACT

A pair of shear blades and a blowout preventer having the pair of shear blades. The shear blades are configured to cut a tubular inside the blowout preventer. The shear blades have different geometries of the front cutting surfaces. One geometry promotes a secure positioning of the tubular relative to the first blade while the second geometry promotes a puncturing of the tubular by the second blade.

20 Claims, 10 Drawing Sheets

200
204
202
208
206

200
204
212
216
202
210
56
214
208
250
230
224
232
220
222
242
234
238
208
206
240
236
244

252
204
242
Z
210
216
200

204
228
220
222
226

SHEAR BLADE GEOMETRY AND METHOD

BACKGROUND

1. Technical Field

Embodiments of the subject matter disclosed herein generally relate to methods and systems and, more particularly, to designs of shear blades that more securely shear a tubular.

2. Discussion of the Background

During the past years, with the increase in price of fossil fuels, the interest in developing new production fields has dramatically increased. At the same time, the equipment for extracting the oil is undergoing continuous changes for becoming more effective and reliable. A ram blowout preventer (BOP) is used in most wells for ensuring that the wells are closed in the event that a high pressure develops inside the wells or when various tests are conducted or when equipment above the BOP needs to be replaced or removed. Thus, the BOP is configured to act as a valve. Shear BOP are configured to not only close the well but also cut any tubular or tools that may be present inside the well.

For example, it may happen that during drilling, while the drill string is inside the well, a high pressure pocket is intersected by the drill. In this case, the shear ram BOP is used to cut the drill string to seal the well to prevent the high pressure from propagating to the rig above for safety reasons. The shear ram BOP traditionally includes two blades that move towards each other for shearing the tubular. However, there are instances when the existing blades are not capable of shearing the tubular or tools inside the well, thus failing to seal the well. This failure to shear the tubular may result in catastrophic events that may destroy the rig and may result in loss of human lives. For a better understanding of how the blades shear the tubular, a BOP is discussed next.

A shear ram BOP is shown in FIG. 1. A BOP 16 is shown having ram blocks 20. The ram blocks 20 are configured to move, when actuated by a rod 22, inside a first elongated cavity 24. The first elongated cavity 24 extends along a first axis X. A second elongated cavity 26 extends along axis Y, substantially perpendicular to and intersecting the first elongated cavity 24. The ram block 20 may include a shear blade 28 that is configured to cut a tubular 30 that may be present inside a well 32. The shear blade 28 may have a sharp edge that effectively cuts tool 30 when necessary. Another similar shear block and shear blade may be provided in an opposite region of the first elongated cavity 24.

A more detailed view of the ram block 20 and the shear blade 28 is shown in FIG. 2. The shear blade 28 is shown detached from the ram block 20. To attach the shear blade 28 to the ram block 20, a plurality of screws 36 are used. Corresponding holes 38 are formed in a frontal face 40 of the ram block 20. The sharp edge 42 of the shear blade 28 is configured to shear the tool. The thicker the tools provided inside well 32, the more powerful ram blocks 20 and blades 28 need to be provided to resist to the high pressures present inside the BOP when cutting the tool. Such pressure may be between 2,000 and 25,000 psi.

A top view of a pair of conventional shear blades 28 is shown in FIG. 3. It is noted that the two blades 28 are symmetrical and have two cutting edges 44 and 46 that make a large angle $\alpha$ between 120° and 180°. These edges may determine the tubular to move to a central position. However, these cutting edges may fail to shear the tubular if the walls of the tubular are strong or the size of the tubular is larger than a certain value.

Accordingly, it would be desirable to provide systems and methods that avoid the afore-described problems and drawbacks.

SUMMARY

According to one exemplary embodiment, there is a pair of shear blades to be provided in a ram blowout preventer for cutting a tubular. The pair of shear blades includes a first blade having cutting edges provided substantially in a same plane; and a second blade having cutting edges provided in two planes substantially parallel so that the cutting edges of the first blade fit between the cutting edges of the second blade. The first blade has a projection portion configured to fit into a cavity of the second blade.

According to another exemplary embodiment, there is a shear ram blowout preventer (BOP) that includes a body having a first elongated cavity extending along a first axis and a second elongated cavity extending perpendicular to and intersecting the first elongated cavity; a pair of ram blocks provided in the first elongated cavity and configured to slide along the first axis, wherein the ram blocks have frontal faces facing each other and the frontal faces are configured to slide towards the second elongated cavity; and the pair of shear blades noted in the previous paragraph.

According to still another exemplary embodiment, there is a method for manufacturing shear blades for cutting a tubular inside a blowout preventer. The method includes forming a first blade having a front cutting face having a first geometry, the first geometry promoting a secure positioning of the tubular relative to the first blade; forming a second blade having a front cutting face having a second geometry different from the first geometry, the second geometry promoting a puncturing of the tubular prior to cutting; forming cutting edges on the front cutting faces of the first and second blades; and installing the first and second blades in a same blowout preventer. The cutting edges of the first and second blades are configured to cut the tubular when actuated.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of shear ram BOP systems. However, the embodiments to be discussed next are not limited to these systems, but may be applied to other systems that require cutting a tool.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a pair of shear blades to be used in a shear BOP are different from each other. A first blade of the pair has a shape that promotes a movement of the tubular towards a central location, and a second blade has a projection portion that is configured to pierce the tubular while secured at the central location of the first blade. Thus, the two blades work in tandem, one positioning the tubular at a desired position and the other one puncturing the tubular. Cutting the tubular is achieved by cutting edges of both blades. It is noted that the term "shear" used in the exemplary embodiments is not limited to two blades that cut while overlapping each other. This term is understood also to cover the situation when the blades press the tubular between them and the blades do not overlap with each other.

Figure 1:
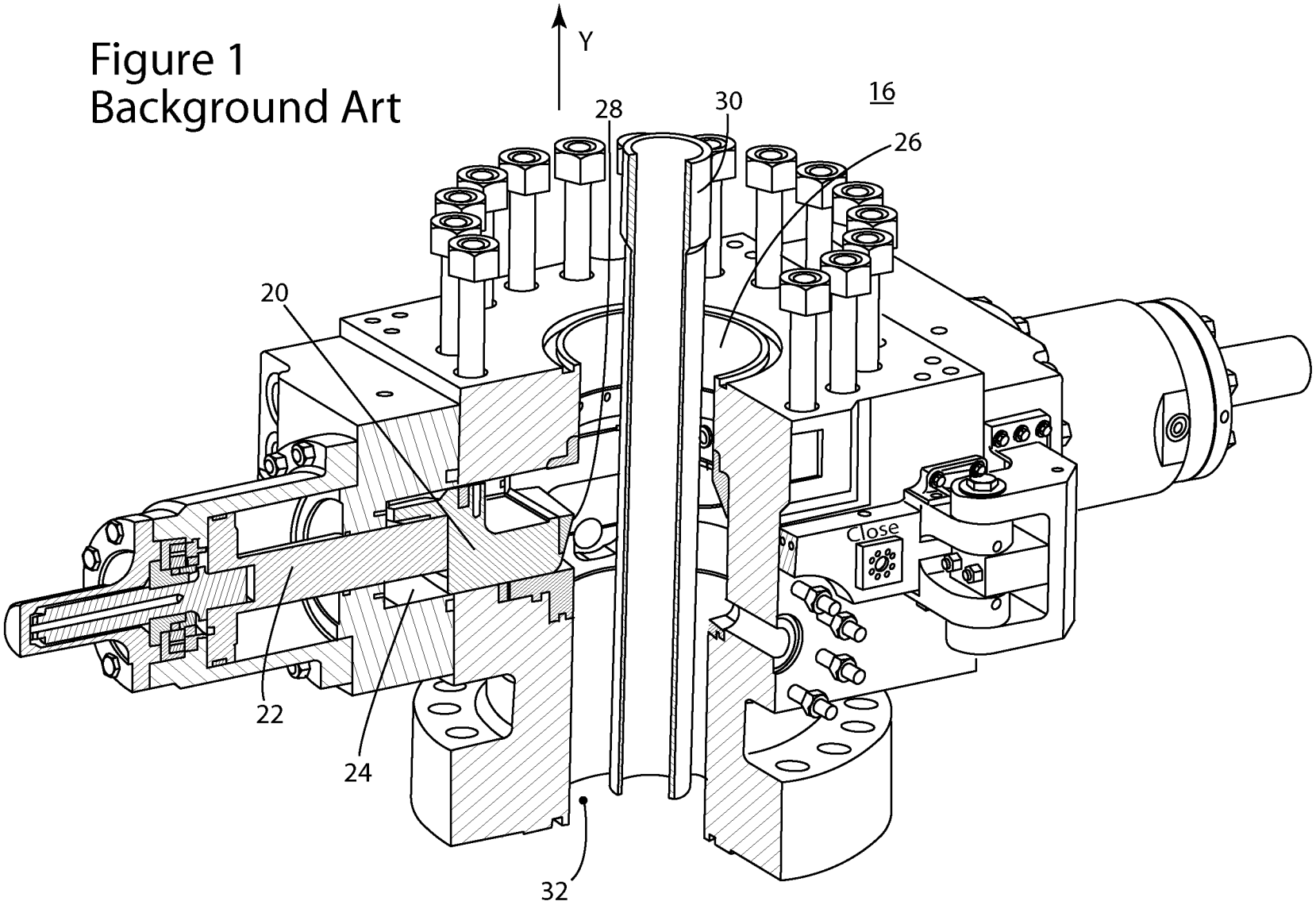
Figure 1 Background Art
FIG. 1 is a schematic diagram of a conventional blowout preventer.
Figure 2:
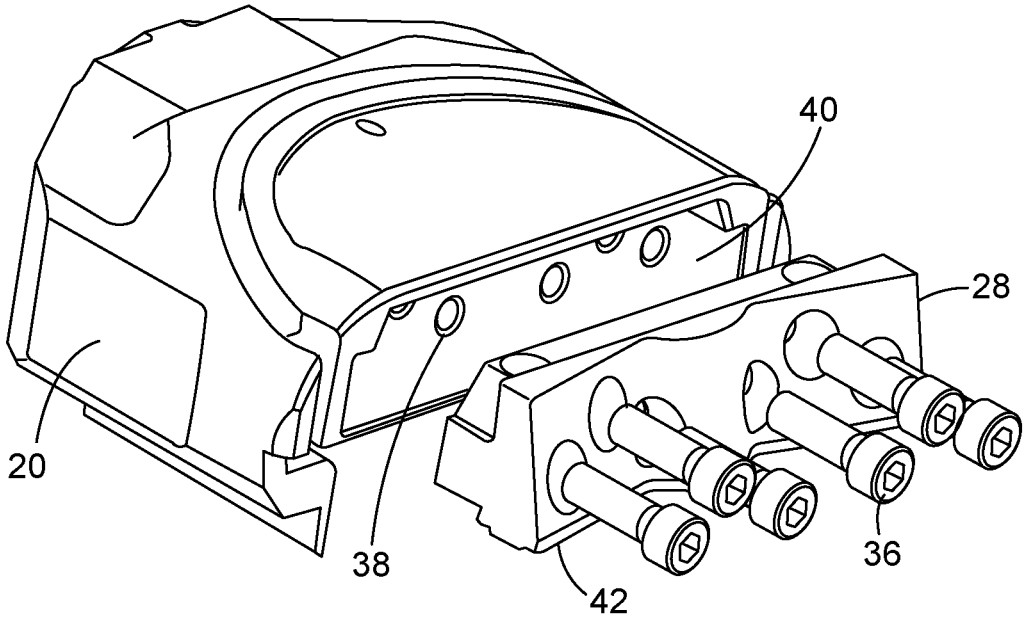
FIG. 2 Background Art
FIG. 2 is a schematic diagram of a shear block and a shear blade of a conventional blowout preventer.
Figure 3:
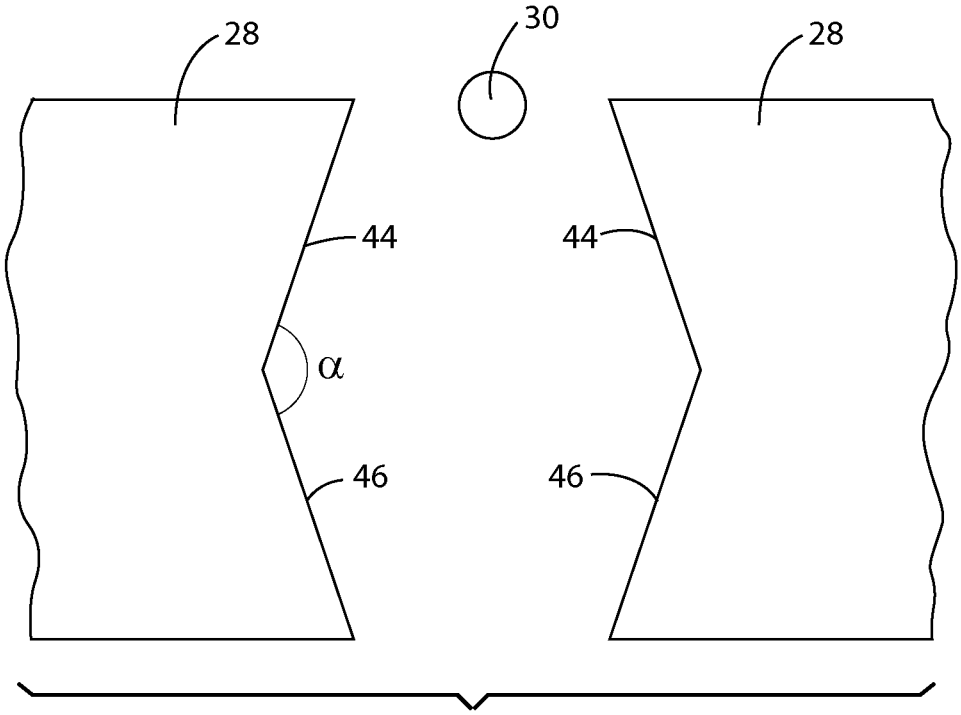
Figure 3 (Background Art)
FIG. 3 is a schematic diagram of a pair of conventional shear blades for a blowout preventer.
Figure 4E:
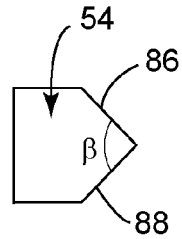
FIGS. 4A-E are schematic diagrams of a pair of shear blades according to an exemplary embodiment.
Figure 4A:
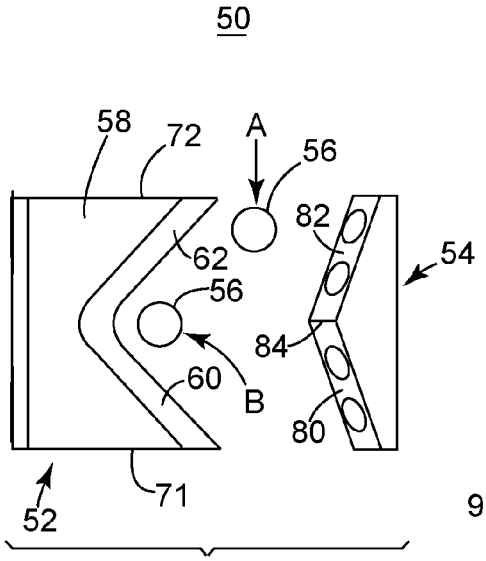
Figure 4B:
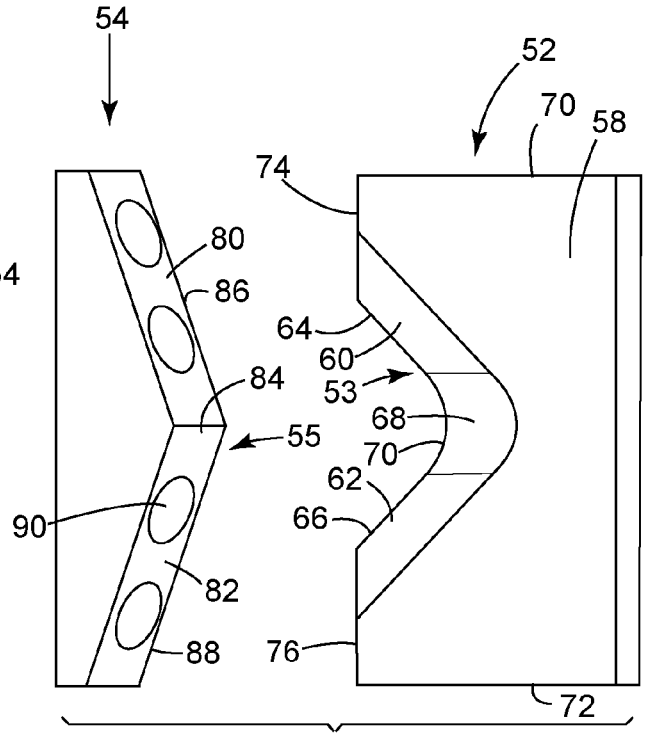
Figure 4D:
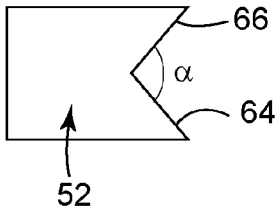
Figure 4C:
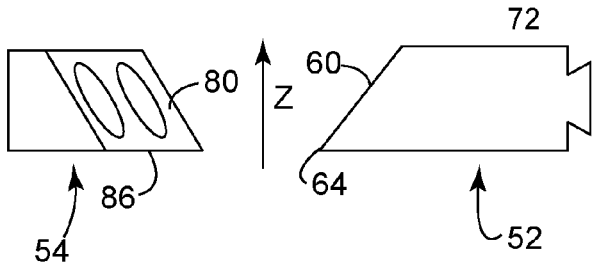

According to an exemplary embodiment illustrated in FIGS. 4A-E, a pair of blades 50 includes a first blade 52 and a second blade 54. The first blade 52 has a V shape that promotes the movement of a tubular 56 from position A to position B when cutting the tubular 56. The first blade 52 has a top face 58, a front face 53 that includes two cutting faces 60 and 62, cutting edges 64 and 66 and a central face 68. The central face 68 connects to the cutting faces 60 and 62 and they together form the face 53 facing the tubular of the first blade. The central face 68 may be curved, as shown in FIG. 4B and has its own cutting edge 70. As shown in FIG. 4C, the cutting surfaces 60 and 62 and/or the central face 68 may be slanted relative to a vertical axis Z.

The first blade 52 is designed to have the cutting edges 64 and 66 at an angle $\alpha$ (see FIG. 4D) between 80° and 120° (to form a V-shape) so that the tubular 56 moves towards the central face 68 when acted upon by both blades 52 and 54. The first blade 52 may be designed such that the cutting faces 60 and 62 intersect edges 71 and 72 of the blade as in FIG. 4A or to have supplemental front faces 74 and 76 as shown in FIG. 4B. Faces 74 and 76 may be slanted or parallel to axis Z and they also may have or not cutting edges.

The profile of the second blade 54 is different from the first blade 52. For example, the second blade 54 has a front face 55 having two front cutting faces 80 and 82 that intersect each other at an edge 84. Each front cutting face 80 and 82 have corresponding cutting edges 86 and 88. An angle $\beta$ (see FIG. 4E) between the cutting edges 86 and 88 may be different from angle $\alpha$. Angle $\beta$ may have a value of about 60°. The front cutting faces 80 and 82 may be slanted relative to axis Z as shown in FIG. 4C. The slant of the front cutting faces 80 and 82 and the cutting surfaces 60 and 62 may be between 13 and 30°. FIG. 4B shows holes 90 in the front cutting faces 80 and 82. These holes are configured to accommodate bolts that attach the shear blade to the shear ram block. However, the holes 90 are not necessary as other means for attaching the blades to the ram blocks are known in the art.

Figure 5A:
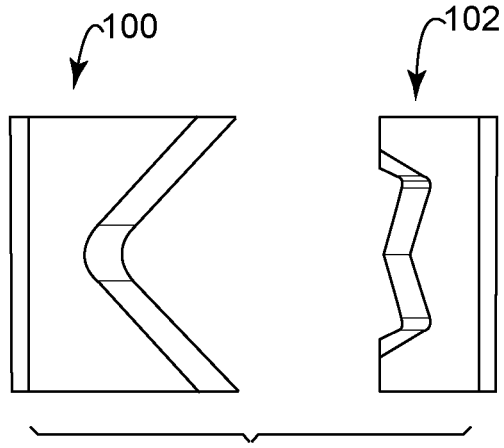
FIGS. 5A-C are schematic diagrams of a pair of shear blades according to another exemplary embodiment.
Figure 5B:
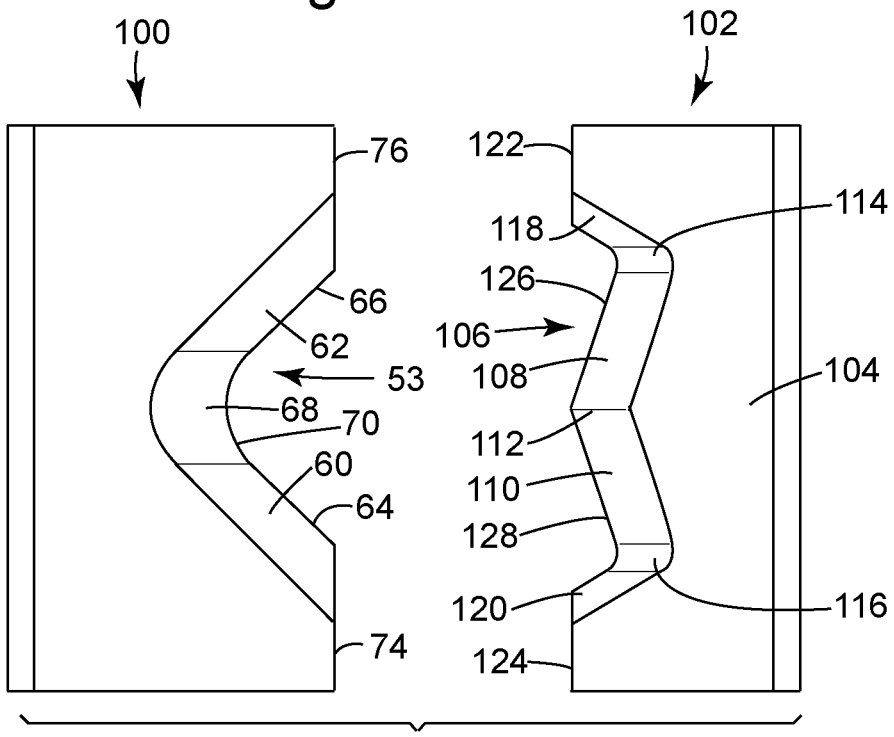
Figure 5C:
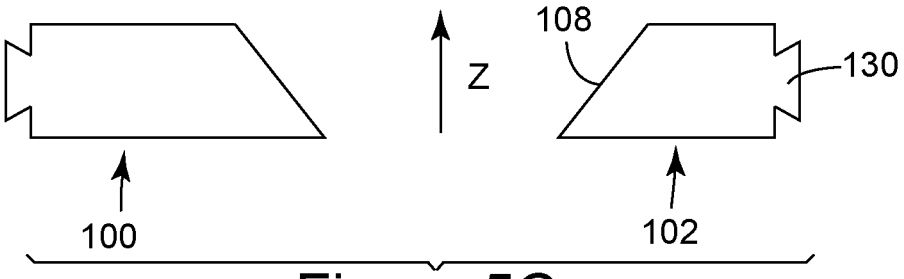

In another exemplary embodiment illustrated in FIGS. 5A-C, a first blade 100 is similar to blade 52 previously discussed. Thus, the details of blade 100 are not further discussed here. A second blade 102 has multiple cutting faces as discussed next. According to this exemplary embodiment, the second blade 102 has a cutting edge that resembles a W-shape. As shown in FIG. 5B, the second blade 102 has a top surface 104 and a front surface 106. The front surface 106 includes first and second cutting surfaces 108 and 110 that intersect each other at an edge 112. The first cutting surface 108 continues with a first curved cutting surface 114 and the second cutting surface 110 continues with a second curved cutting surface 116. The first curved cutting surface 114 continues with a third cutting surface 118 and the second curved cutting surface 116 continues with a fourth cutting surface 120. The first to fourth cutting surfaces 108, 110, 118 and 120 may be flat surfaces. Finally, the third cutting surface 118 continues with a fifth surface 122 and the fourth cutting surface 120 continues with a sixth surface 124.

In one application, the fifth and sixth surfaces 122 and 124 are not cutting surfaces. Further, the fifth and sixth surfaces 122 and 124 extend in a plane that includes axis Z while the first to fourth cutting surfaces may be slanted relative to the Z axis as shown in FIG. 5C. Each cutting surface has a corresponding cutting edge. FIG. 5B shows for simplicity only the cutting edges 126 and 128 of the first and second cutting surfaces 108 and 110.

FIG. 5C shows a projection 130 of the second blade 102 (blade 100 may have a similar projection) that is configured to enter into a corresponding groove in the ram block for attaching the blade to the ram block. Thus, in this embodiment there is no need to have holes in the blades and bolts to attach the blades to the ram blocks.

Figures 6A, 6B, 6C, 6D:
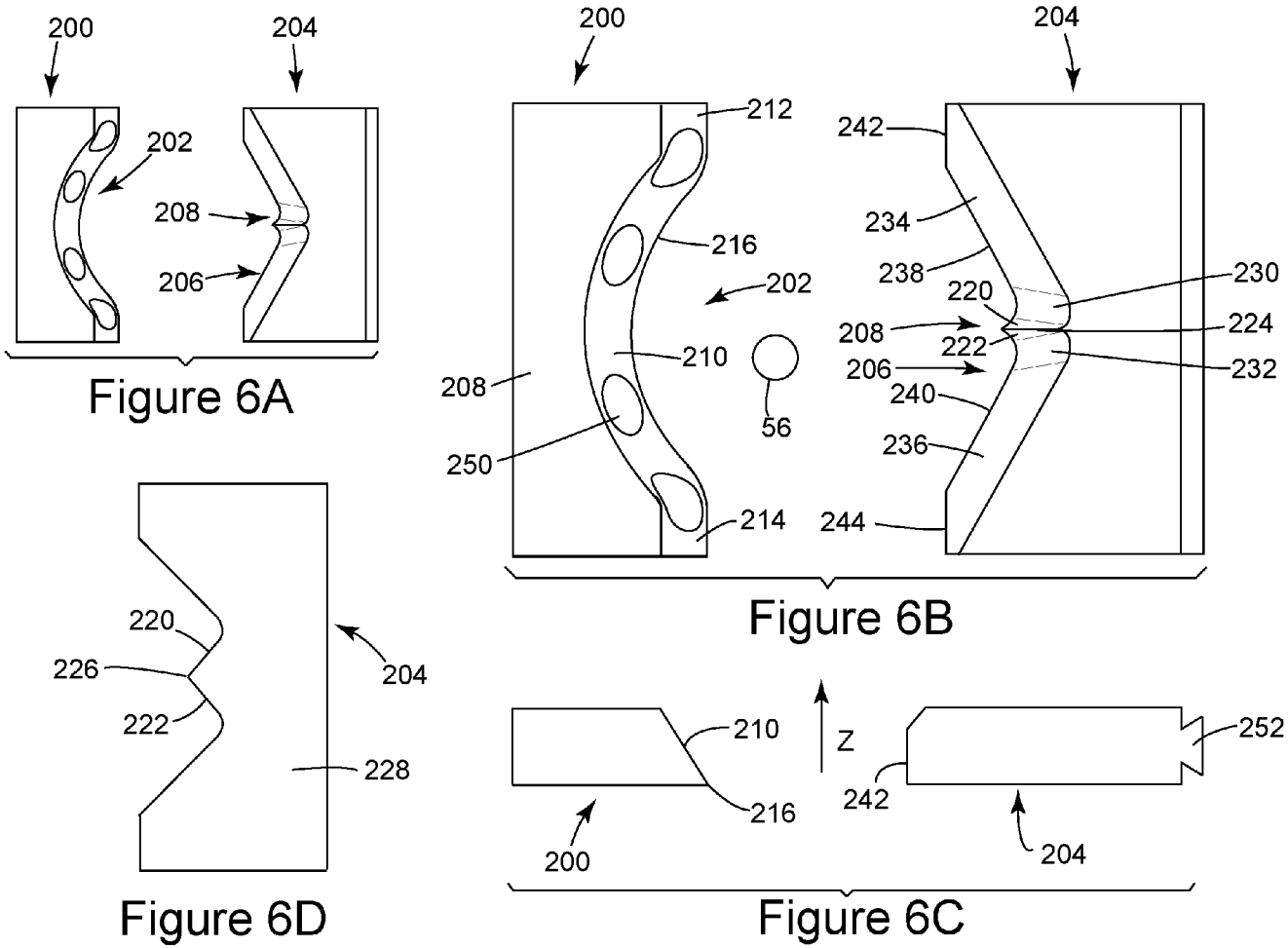
FIGS. 6A-D are schematic diagrams of a pair of shear blades according to still another exemplary embodiment.

According to another exemplary embodiment illustrated in FIGS. 6A-C, a first blade 200 has a front cutting surface 202 and a second blade 204 has a front cutting surface 206 that has a projection 208 in a central region of the blade. More specifically, as shown in FIG. 6B, the first blade 200 has a top face 208 and the front cutting surface 202. The front cutting surface 202 includes a curved cutting face 210 and front flat cutting surfaces 212 and 214. Each cutting surface has a corresponding cutting edge 216. While the curved cutting face 210 may be slanted relative to axis Z as shown in FIG. 6C, the front flat cutting surface 212 and 214 are parallel to axis Z.

The second blade 204 has the central projection 208 including flat cutting surfaces 220 and 222 that intersect each other at edge 224. The flat cutting surfaces 220 and 222 may be slanted to axis Z. The edge 224 is also slanted to axis Z and has a most projected point 226 as shown in FIG. 6D, which shows a back face 228 of the second blade 204. Flat cutting surfaces 220 and 222 of the projection 208 continue with first and second cutting surfaces 230 and 232 of the cutting surface 206. The cutting surfaces 230 and 232 are slanted to axis Z and curved. They continue with third and fourth cutting surfaces 234 and 236 which have cutting edges 238 and 240. Cutting surfaces 220, 222, 230 and 232 may also have cutting edges but are not referenced for simplicity. However, in one application, these cutting surfaces do not have cutting edges.

Third and fourth cutting surfaces 234 and 236 continue with fifth and sixth surfaces 242 and 244. These surfaces may be non-cutting surfaces and may be parallel to the Z axis. These surfaces may be designed to match surfaces 212 and 214 of the first blade 200. The most projected point 226 of the second blade 204 may be in fact a small surface. However, surface or point, the most projected point 226 is configured to pierce a tubular 56 positioned between blades 200 and 204 and cutting edges 216, 238, and 240 are configure to completely cut the tubular. FIG. 6B shows holes 250 in the first blade 200 for attaching this blade to the corresponding ram block while FIG. 6C shows a projection 252 of the second blade 204 to be slided in a corresponding groove in the corresponding ram block. Other mechanisms for attaching the blades to the ram blocks may be used.

Figure 7A:
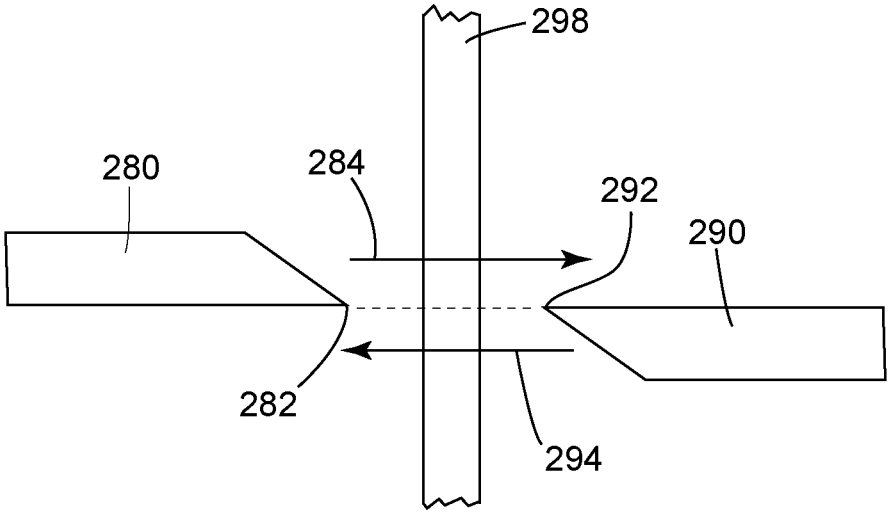
FIGS. 7A-B schematically illustrate how the pair of shear blades shear a tubular according to an exemplary embodiment.
Figure 7B:
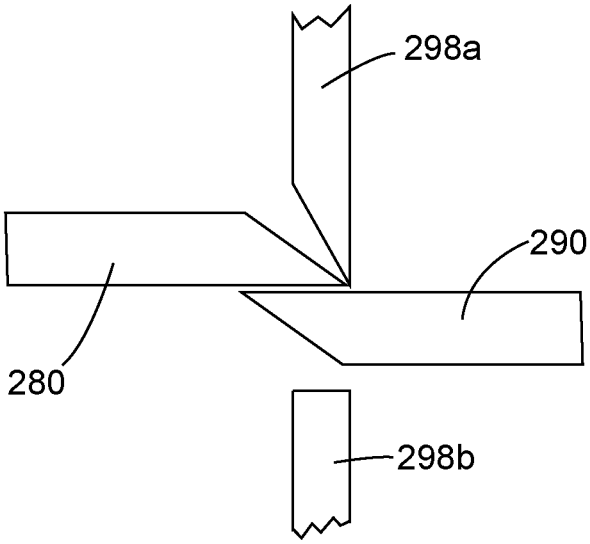

The embodiments shown in FIGS. 4A to 6D share the following feature illustrated in FIG. 7A. Considering generic blades 280 and 290 having respective cutting edges 282 and 292, and considering a tubular 298 provided between the two blades, it is noted that blade 280 moves along line 284 and blade 290 moves along line 294, which are substantially parallel but not the same. Further, it is noted that when shearing the tubular, the blade 280 overlaps blade 290 as shown in FIG. 7B, and the upper part 298*a* of the tubular has been severed from the lower part 298*b* of the tubular 298.

Figure 8A:
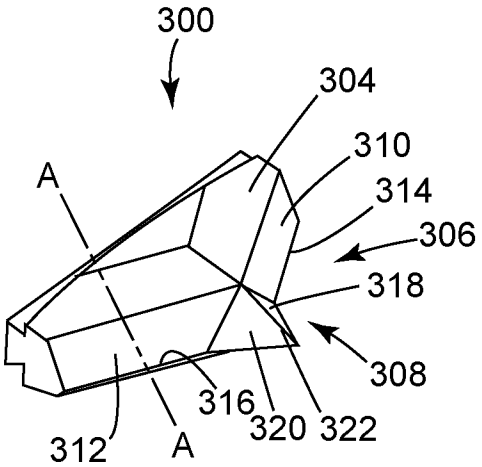
FIGS. 8A-F are schematic diagrams of a pair of shear blades according to yet another exemplary embodiment.
Figure 8B:
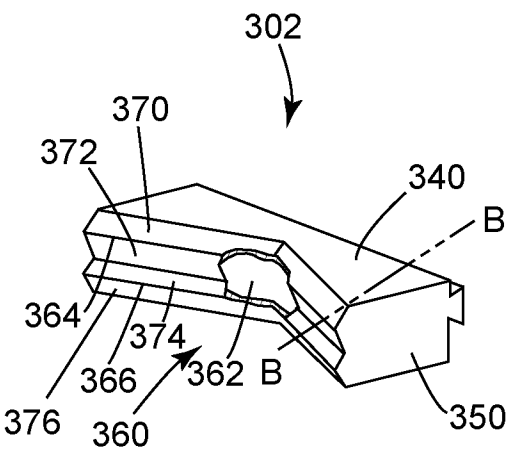
Figure 8C:
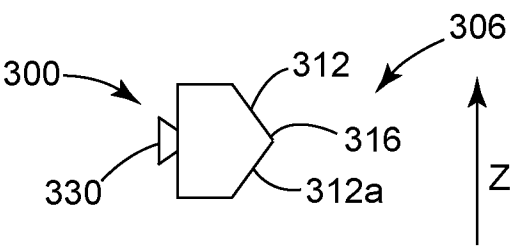

According to another exemplary illustrated in FIGS. 8A-8C, a first blade 300 has a cutting edge and a second blade 302 has a dual cutting edge configured to receive the cutting edge of the first blade. More specifically, as shown in FIG. 8A, the first blade 300 has a top surface 304 and a front face 306. A projection portion 308 extends from a central portion of the front face 306 and this projection portion is designed to pierce the tubular. The front face 306 has an upper portion (seen in FIG. 8A) and a lower portion (not seen in FIG. 8A), each having first and second cutting faces. For simplicity, only the upper portion of the front face 306 is described next. The upper portion has a first cutting face 310 and a second cutting face 312, each having a cutting edge 314 and 316, respectively. Symmetrical faces (shown in FIG. 8F) are provided on the lower part. In one application, the faces on the lower part are not identical to the faces on the upper part. The lower part includes mirror face 310*a*, symmetrical to face 310 and mirror face 312*a* symmetrical to face 312. The intersection of faces 310 and 310*a* forms the cutting edge 314 and the intersection of faces 312 and face 312*a* forms the cutting edge 316. The projection portion 308 has a first cutting face 318 and a second cutting face 320 that intersect each other at an edge 322. The first and second cutting faces 318 and 320 have their own cutting edges.

Figure 8D:
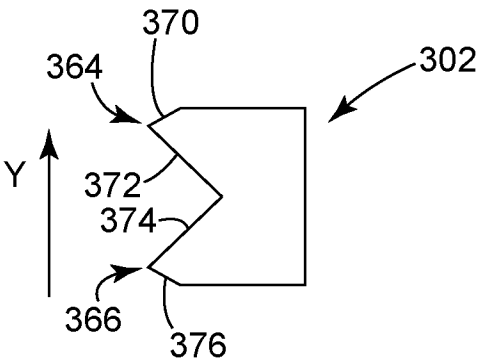
Figure 8E:
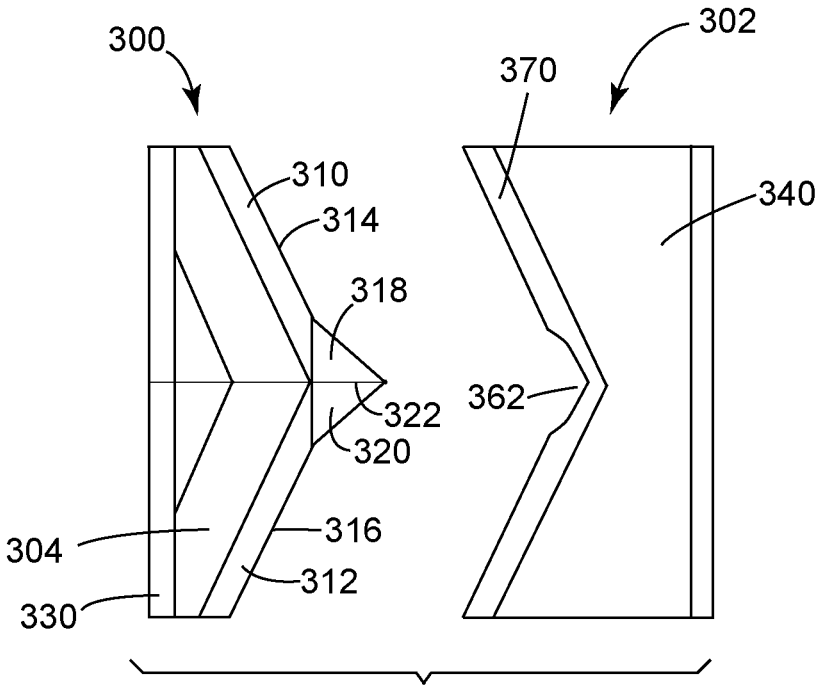
Figure 8F:
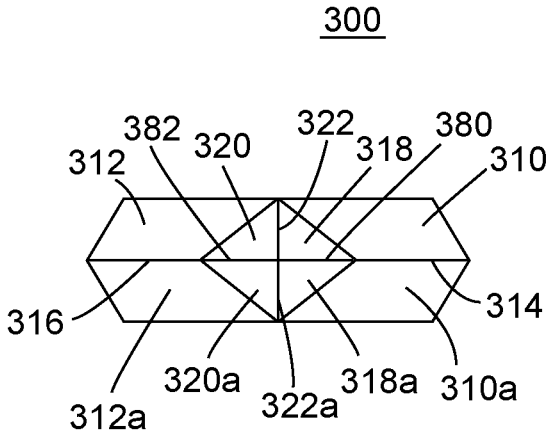

A cross section along line A-A in FIG. 8A of the front face 306 is shown in FIG. 8C. In this figure it is visible the second cutting face 312 on the upper part and its symmetrical mirror face 312*a* on the lower part of the front face 306. The same is true for faces 310, 318, and 320 as shown in FIG. 8F. A top view of the first blade 300 is shown in FIG. 8E. It is noted that faces 310, 312, 318, and 320 are slanted relative to a vertical axis Y as shown in FIG. 8C. Further, FIG. 8C shows a projection 330 on the back face of the first blade 300 and this projection is configured to slide into a groove in the ram block for securing the blade to the ram block.

The second blade 302 is illustrated in FIGS. 8B, D and E. It is noted that this blade has a top face 340, side faces 350 and a front cutting face 360. The front cutting face 360 has a V-shape. The V-shape is made by two edges on each arm and a cavity 362 in a central region for accommodating the projection portion 308 of the first blade 300. The front cutting face 360 includes on each side of the V-shape an upper cutting edge 364 and a lower cutting edge 366. The cutting edges 364 and 366 are spaced to receive the cutting edges 314 and 316 of the first blade 300. A profile of the second blade 302 along line B-B in FIG. 8B is shown in FIG. 8D. It is noted four cutting faces 370, 372, 374, and 376 that intersect in pairs at the cutting edges 314 and 316.

To place in perspective the profile of the first blade 300, FIG. 8F shows the first blade 300 from a front view so that the first cutting face 310 and second cutting face 312 are shown forming the upper part of the blade and the mirror first and second cutting faces 310*a* and 312*a* form the lower part of the blade. The projection portion 308 is shown having the upper first and second projection faces 318 and 320 and the lower first and second mirror projection faces 318*a* and 320*a*. The corresponding edges 380 and 382 are also shown.

Figure 9:
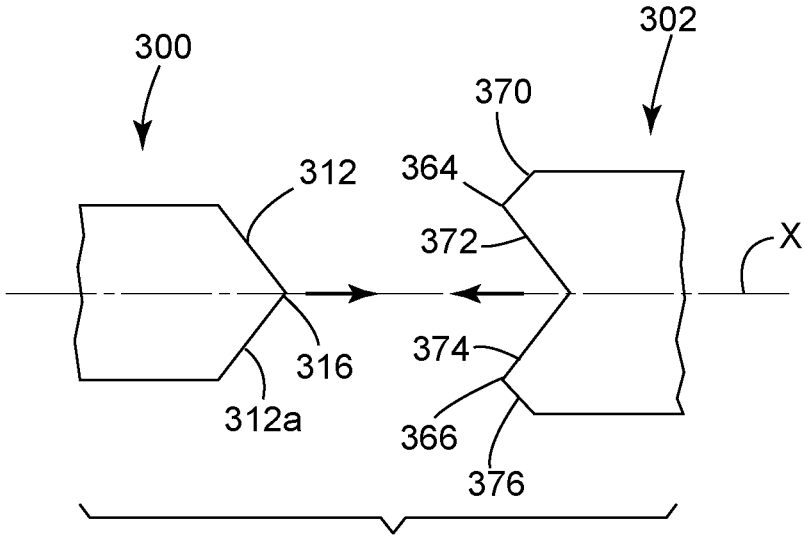
FIG. 9 schematically illustrates how the pair of shear blades of FIGS. 8A-F shear a tubular according to an exemplary embodiment.

Different from the previously discussed embodiments, the first and second blades 300 and 302 are designed to move along the same line X, but in opposite direction, for severing a tubular as shown in FIG. 9.

Figure 10:
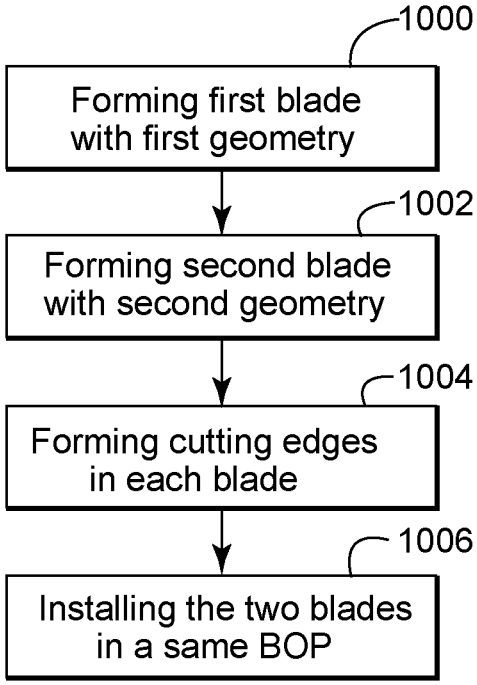
FIG. 10 is a flow chart illustrating a method for manufacturing a pair of shear blades according to an exemplary embodiment.

According to an exemplary embodiment illustrated in FIG. 10, there is a method for manufacturing a pair of shear blades for a BOP such that the shear blades have different geometries. The method includes a step 1000 of forming the first blade to have a first geometry that promotes a secure location of a tubular to be cut with the pair of blades, and a step 1002 of forming the second blade to have a second geometry, different from the first geometry, that promotes a cutting of the tubular. The method further includes a step 1004 of forming cutting edges on both the first and second blades, and a step 1006 of installing the two blades in a same BOP for cutting the tubular. It is noted that blades from different embodiments may be mixed together in a same BOP.

The disclosed exemplary embodiments provide a pair of blades and a BOP that more securely shear a tool or tubular present inside the BOP. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A pair of shear blades to be provided in a ram blowout preventer for cutting a tubular, the pair of shear blades comprising:

a first blade having first blade cutting edges provided substantially in a same horizontal plane and extending horizontally across the first blade;

a second blade having upper and lower second blade cutting edges provided in two horizontal planes substantially parallel with each other and extending horizontally across the second blade, and a horizontally extending recess between the upper and lower second blade cutting edges, the recess having a length at least equal to a total length of the first blade cutting edges, so that the first blade cutting edges fit into the recess between the upper and lower second blade cutting edges when the blades are moved toward a shearing position; and wherein the first blade has a projection portion protruding past the first blade cutting edges and configured to fit into the recess of the second blade.

2. The pair of shear blades of claim 1, further comprising a cavity within a central portion of the recess of greater depth than remaining portions of the recess, the cavity receiving the projection portion of the first blade when the blades are in the shearing position.

3. The pair of shear blades of claim 1, wherein the first blade comprises an upper surface extending upward and rearward from the first blade cutting edges, a lower surface extending downward and rearward from the first blade cuttings edges, the upper and lower surfaces extending the total length of the first blade cutting edges and being mirror images with each other.

4. The pair of shear blades of claim 1, wherein the first blade comprises:

an upper cutting surface extending upward from the first blade Cutting edges, and a lower cutting surface extending downward from the first blade cutting surfaces; wherein the upper and lower cutting surfaces extend the total length of the first blade cutting edges.

5. The pair of shear blades of claim 1, wherein the first blade cutting edges extend across the projection portion, defining an upper part extending upward from the first blade cuttings edges and a lower part extending downward from the first blade cuttings edges.

6. The pair of shear blades of claim 5, wherein the projection portion has a configuration of a four-sided pyramid.

7. The pair of shear blades of claim 1, wherein the upper and lower second blade cutting edges have a V-shape with a central portion rearward of outer ends of the cutting edges.

8. The pair of shear blades of claim 1, wherein the second blade has a top surface and a bottom surface joined by opposite sides, and the upper and lower second blade cutting edges extend from one of the sides to the other.

9. The pair of shear blades of claim 1, wherein the upper second blade cutting edges are located directly above the lower second blade cutting edges.

10. A shear ram blowout preventer (BOP), comprising:

a body having a first elongated cavity extending along a horizontal axis and a second elongated cavity extending perpendicular to and intersecting the first elongated cavity;

a pair of ram blocks provided in the first elongated cavity and configured to slide along the horizontal axis, wherein the ram blocks have frontal faces facing each other and the frontal faces are configured to slide towards the second elongated cavity;

a pair of shear blades configured to be attached to the ram blocks and also configured to shear a tubular provided in the second elongated cavity when the ram blocks slide towards the tool, wherein the pair of shear blades comprises:

a first blade having first blade cutting edges provided substantially in a same horizontal plane and extending horizontally across the first blade; and a second blade having upper and lower second blade cutting edges provided in upper and lower horizontal planes and extending horizontally across the second blade, and a horizontally extending recess between the upper and lower second blade cutting edges having a length at least equal to a total length of the first blade cutting edges so that the first blade cutting edges fit in the recess between the upper and lower second blade cutting edges when the first and second blades are moved to a shearing position, wherein the first blade has a projection portion configured to fit into a cavity within the recess of the second blade, the cavity having a greater depth than the recess.

11. The shear ram BOP of claim 10, wherein the projection portion of the first blade and the cavity of the second blade are in a central region of the blades.

12. The shear ram BOP of claim 10, wherein:

the first blade cutting edges comprise two lateral cutting edges that join the projection portion and diverge rearwardly from the projection portion; and the recess has two lateral portions that join the cavity and diverge forwardly from the cavity.

13. The shear ram BOP of claim 10, wherein the first blade comprises:

an upper part extending upward and slanting rearward from the first blade cutting edge; and a lower part extending downward and slanting rearward from the first blade cutting edges; and the upper and lower parts being mirror images of each other.

14. The shear ram BOP of claim 10, wherein the first blade cutting edges extend across the projection portion, defining an upper part of the projection portion and a lower part of the projection portion, the upper and lower parts of the projection portion being mirror images of each other.

15. The shear ram BOP of claim 14, wherein the projection portion has a configuration of a four-sided pyramid.

16. The shear ram BOP of claim 10, wherein the second blade has a top surface and a bottom surface joined by opposite sides, and the upper and lower second blade cutting edges extend from one of the sides to the other.

17. The shear ram BOP of claim 16, wherein the upper second blade cutting edges are located directly above the lower second blade cutting edges.

18. The shear ram BOP of claim 17, wherein the upper and lower second blade cutting edges are substantially identical to each other.

19. A shear ram blowout preventer (BOP), comprising:

a body having a first elongated cavity extending along a horizontal axis and a second elongated cavity extending perpendicular to and intersecting the first elongated cavity;

a pair of ram blocks provided in the first elongated cavity and configured to slide along the horizontal axis, wherein the ram blocks have frontal faces facing each other and the frontal faces are configured to slide towards the second elongated cavity;

a pair of shear blades configured to be attached to the ram blocks and also configured to shear a tubular provided in the second elongated cavity when the ram blocks slide towards the tool, wherein the pair of shear blades comprises:

a first blade having a front face;

a first blade cutting edge extending in a horizontal plane across and protruding from the front face of the first blade;

a second blade having a front face;

an upper second blade cutting edge extending in a horizontal plane and protruding from the front face of the second blade, the horizontal plane containing the upper second blade cutting edge being above the horizontal plane containing the first blade cutting edge;

a lower second blade cutting edge extending in a horizontal plane and protruding from the front face of the second blade, the horizontal plane containing the lower second blade cutting edge being lower than the horizontal plane containing the first blade cutting edge;

a recess in the front face of the second blade between the upper and lower second blade cutting edges having a length at least equal to a length of the first blade cutting edge, the upper and lower second blade cutting edges protruding past the recess; and wherein the first blade cutting edge fits in the recess between the upper and lower second blade cutting edges when the first and second blades are moved to a shearing position.

20. The shear ram BOP of claim 19, wherein the first blade cutting edge and the recess have mating V-shapes.

* * * * *

UNITED STATES PATENT AND TRADEMARK OFFICE

CERTIFICATE OF CORRECTION

PATENT NO. : 8,505,870 B2
APPLICATION NO. : 13/019438
DATED : August 13, 2013
INVENTOR(S) : Yadav et al.

It is certified that error appears in the above-identified patent and that said Letters Patent is hereby corrected as shown below:

In the Claims:

In Column 7, Line 32, in Claim 4, delete "Cutting edges," and insert -- cutting edges, --, therefor.

Signed and Sealed this
Third Day of June, 2014

Michelle K. Lee

Michelle K. Lee
*Deputy Director of the United States Patent and Trademark Office*